United States Patent [19]

Jannsen

[11] 4,182,418

[45] Jan. 8, 1980

[54] METHOD FOR PERFORATING WATER WELL PIPE CASINGS

[76] Inventor: Edward M. Jannsen, 2855 NW. Saltzman Rd., Portland, Oreg. 97229

[21] Appl. No.: 834,908

[22] Filed: Sep. 20, 1977

[51] Int. Cl.[2] ..... E21B 43/112

[52] U.S. Cl. ..... 166/298; 166/55.2; 166/55.1; 166/312; 175/269

[58] Field of Search ..... 166/55.1, 55.2, 55.3, 166/293, 311, 312; 175/234, 241, 267–269; 30/103–106

[56] References Cited

U.S. PATENT DOCUMENTS

| | | | |
|---|---|---|---|
| 808,235 | 12/1905 | Graham | 166/55.3 |
| 984,702 | 2/1911 | Raine | 166/55.3 |
| 1,508,230 | 9/1924 | Lewis | 175/241 X |
| 1,900,226 | 3/1933 | Conant | 175/269 |
| 1,927,310 | 9/1933 | Edwards | 166/298 |
| 2,809,016 | 10/1957 | Kammerer, Jr. | 175/267 |

*Primary Examiner*—Ernest R. Purser
*Assistant Examiner*—Nick A. Nichols, Jr.
*Attorney, Agent, or Firm*—Francis Swanson

[57] ABSTRACT

A tool for perforating water well pipe casings is disclosed. The tool is designed for use with air rotary water well drilling apparatus. The tool includes a slideable casing perforator wheel actuated by a pneumatic cylinder carried within the tool. The casing may be perforated and subsequent development of the well carried out while the tool is in place. No removal is necessary to carry out well development.

1 Claim, 8 Drawing Figures

FIG. 1
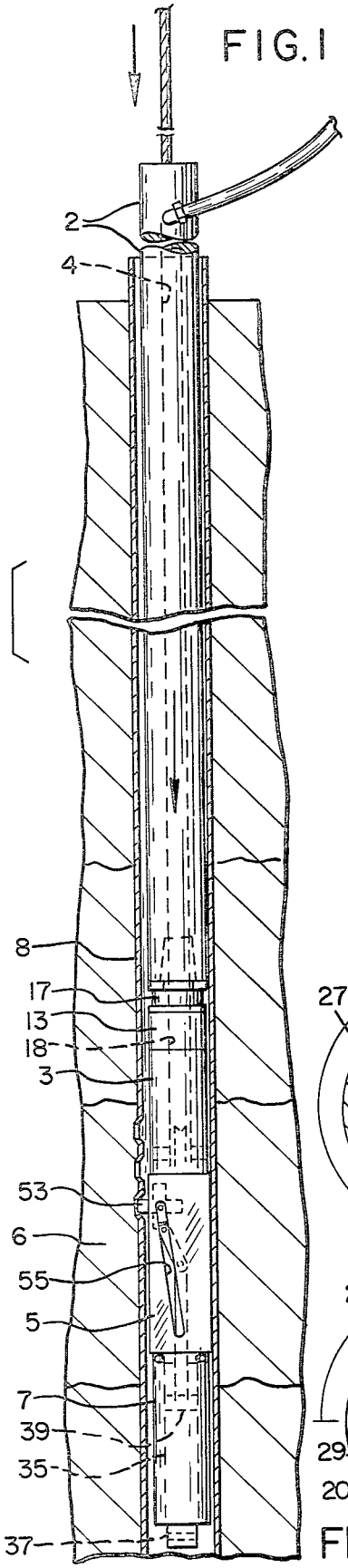
FIG. 2
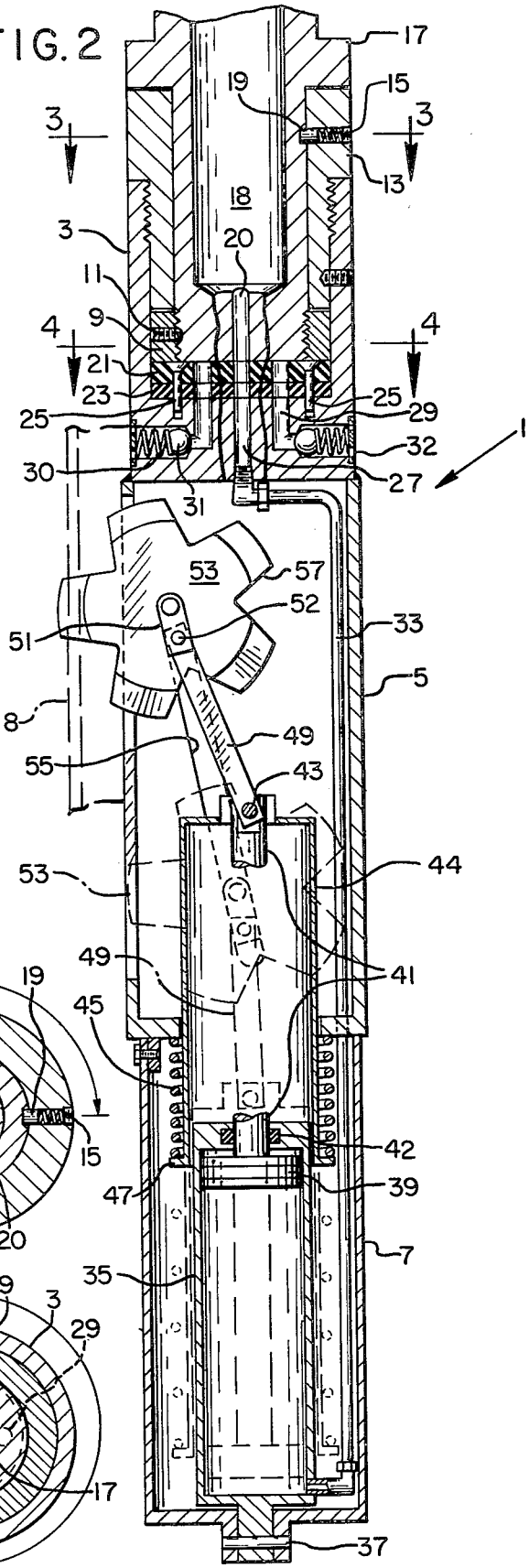
FIG. 3
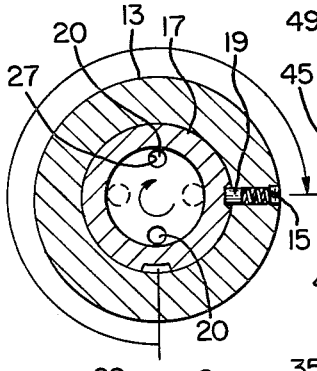
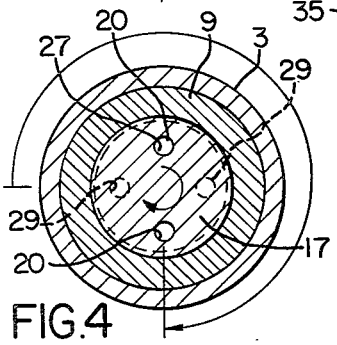
FIG. 4

FIG. 6
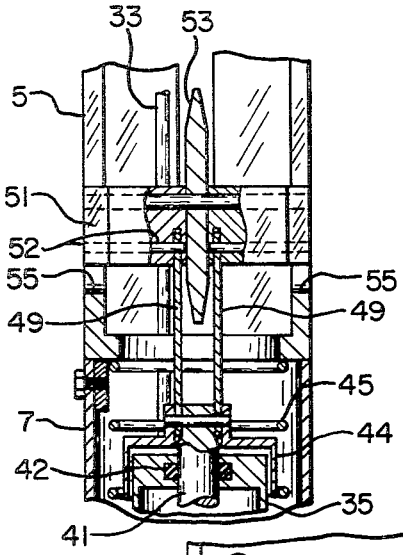
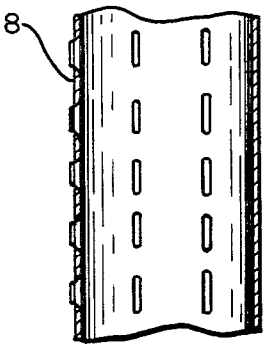
FIG. 8
FIG. 5
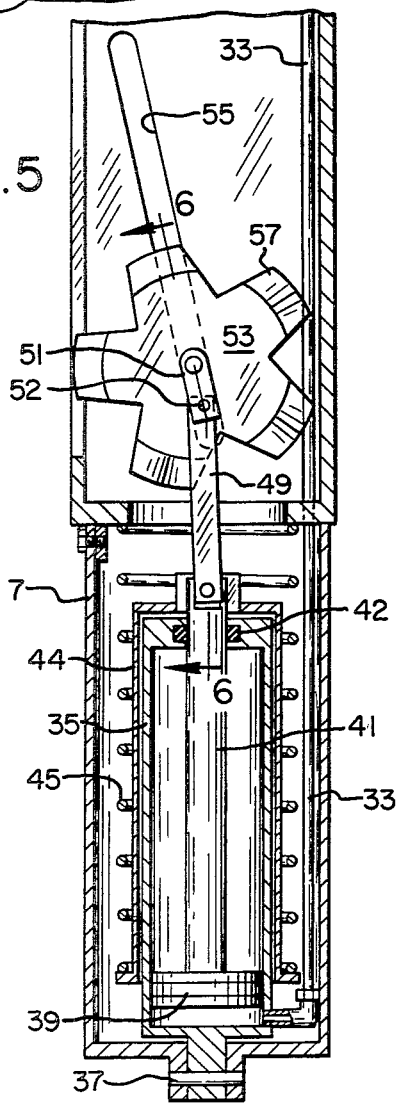
FIG. 7
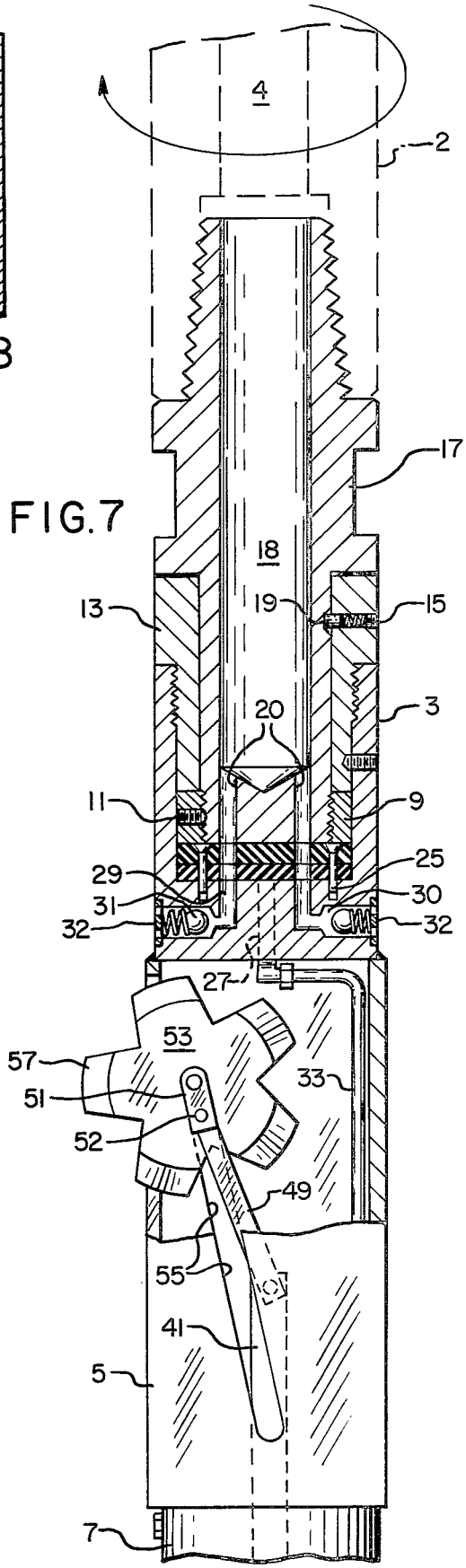

METHOD FOR PERFORATING WATER WELL PIPE CASINGS

BACKGROUND OF THE INVENTION

1. Scope of the Invention

This invention pertains to water well perforating tools in general and more particularly to those with which development of the well can be carried out without removal of the tool.

2. Description of the Prior Art

Perforators for well casings are well known in the art. A star wheel perforator is shown in U.S. Pat. No. 726,625; another is disclosed in U.S. Pat. No. 1,500,829; still another is disclosed in U.S. Pat. No. 1,910,851. These methods all require removal of the drill string and perforator tool before development of the well can be carried out.

OBJECTS AND ADVANTAGES OF THE INVENTION

Development of a well means the removal of the mud, sand and other debris from within the well casing and stabilization of water flow through such removal. In the conventional approach in the known prior art, 25 or more feet of casing at the bottom of the well is first perforated. This is followed by removal of the perforator and insertion of apparatus to blow or pump out the inflowing mud and sand. Removing the perforator and reinsertion of well development apparatus is costly and time consuming. It is therefore a principal object of this invention to produce a tool which is capable of perforating water well casing and subsequently develop the well without the addition of further tooling and without removal of the tool and drill string from the well.

It is a further object of this invention to produce a tool which may be used with air rotary drilling machines.

It is a further object of this invention to produce a single tool capable of both perforation and well development.

It is a further object of this invention to produce a tool by which perforation and development is carried out pneumatically through air discharge from the tool into the space defined by the well casing.

Other objects and advantages will be apparent to those skilled in the art with reference to the accompanying drawings and specifications.

BRIEF DESCRIPTION OF THE DRAWINGS

FIG. 1 is an elevational view of the invention showing the tool attached to the drill string and inserted into the well.

FIG. 2 is a longitudinal sectional view of the tool showing the relation of the internal components.

FIG. 3 is a cross-sectional view taken along line 3—3 of FIG. 2.

FIG. 4 is a cross-sectional view taken along line 4—4 of FIG. 2.

FIG. 5 is a longitudinal sectional view of the lower portion of the tool showing the relation of the pneumatic cylinder and the star wheel which is retracted.

FIG. 6 is a sectional view taken along line 6—6 of FIG. 5.

FIG. 7 is a longitudinal sectional view of upper portion of the tool showing the development apparatus and associated valving.

FIG. 8 is a longitudinal sectional view of a piece of perforated casing.

DETAILED DESCRIPTION

Referring now to FIG. 2, a tool (1) has an upper body (3) joined to one end of a perforator housing (5). The other end of housing (5) is joined to lower body (7). Tool (1) is attached to drill string (2) which has a pressure fluid supply pipe (4). In the preferred embodiment the pressure fluid is air. The source of air and the well drilling machine are not shown.

FIG. 1 shows the tool (1) inserted into water bearing strata (6) within the earth via well casing (8).

Within upper body (3) is a threaded collar (9), which has a set screw (11). Over collar (9) and threaded to upper body (3) is short stub (13) which carries a spring loaded detent (15). Inserted through stub (13) is tool head (17) which threads to collar (9) and contains grooves (19) into which rides detent (15). Within tool head (17) is a pressure air cavity (18) and a plurality of air supply ports (20). Interposed between collar (9), tool head (17) and upper body (3) is a high density polyester seat (21) and a neoprene cushion (23). Alignment of seat (21) and cushion (23) is achieved by floating pins (25). Within seat (21), cushion (23) and upper body (3) are a plurality of air passages. The first is air cylinder supply passage (27). Other remaining two passages (29) connect to development ports (30) and supply air for development of the well. Within ports (30) are a pair of check valves (31) having nozzles (32). Cylinder air passage (27) is connected via air supply tube (33) to a fluid motor in the form of an air cylinder (35) in lower body (7). Cylinder (35) is mounted to lower body (7) with pin (37). Within the cylinder (35) is a piston (39) and a rod (41) sealed with a packing gland (42). Piston rod (41) is pivotally attached by a pin (43) to a return sleeve (44) which surrounds cylinder (35). A return spring (45) is interposed between a lip (47) on sleeve (44) and the bottom surface of housing (5).

Rod (41) is also pivotally connected with pin (43) to a shaft (49) which is, in turn, pivotally connected to a sliding bearing block (51) with pin (52). Perforator wheel (53) is rotatably mounted through shaft (54) on block (51) which slides in guide slots (55) in the sides of housing (5). Wheel (53) defines a series of perforating blades (57).

Operation

It is well known that drilling in unconsolidated formations such as sand and gravel requires advancement of the well casing as drilling is accomplished. Perforation of the casing beforehand is not possible. This step must be carried out after drilling is complete. Development of the well is also carried out after drilling is complete. This refers to the process of forcing the sand, mud and other debris out of the bottom of the well.

With the present invention, once the drilling is complete, tool (1) is lowered into the well and positioned in the area to be perforated. Fluid in the form of Air under presssure fills the air pipe (4) and air cavity (18) in tool head (17). Air enters passages (27) into tube (33) and is routed into cylinder (35). The air pressure forces piston (39) and rod (41) upward. This compresses spring (45) against the bottom surface of housing (5) because return sleeve (44) also moves upward. The movement of rod (41) also forces block (51) and perforator wheel (53) to slide upward along slot (55) and into contact with the wall of the well casing (8).

The drilling rig now forces the tool downward along the length of the perforating area. The perforating blades (57) punch a series of longitudinal holes in casing (8) as wheel (53) rotates under the force of the downward movement of tool (1). After the first series of holes is produced, air pressure is released. Upward movement of tool (1), combined with the return force of spring (45) on return sleeve (44) causes retraction of wheel (53) back into housing (5). The tool (1) can now be rotated slightly to position it to make a second row of perforations. Once tool (1) is in position, air pressure is reapplied to cylinder (35) to again force wheel (53) against the well casing. New downward movement of the drill string will produce further perforations. These are illustrated in FIG. 8. The above-described sequence is repeated until perforating is completed. The development of the well may now be carried out. However, it is preferable to accomplish development by discharging air from a position which is always above the perforations. This prevents aeration of the water bearing formation (6) outside the perforated well casing (8).

Unlike prior art perforators, tool (1) need not be removed from the well to carry out development. The operator need only proceed as follows.

Drill string (2) and tool (1) are raised to a position above the perforations. Wheel (53) is extended and one perforation is made in casing (8). In this position the tool (1) is held firmly against the inner surface of the well and cannot be rotated. However, the drill string (8), air pipe (4) and tool head (17) can be rotated through an angle of 270°. The invention is shown adapted for clockwise rotation. This is merely choice of design. The invention could be made to rotate counter-clockwise equally well. Because tool head (17) is firmly coupled to air pipe (4) as it is rotated through 270°, detent (15) is forced out of groove (19) and into a second identical groove (19) 270° around collar (3). The detent (15) serves to assure that the tool (1) and development nozzles (32) are positioned correctly.

Rotation brings ports (20) in tool head (17) into line with passages (29) in the upper body (3) and shuts off passage (27). Air under pressure from chamber (18) in tool head (17) is forced out through passages (29) into development ports (30), through check valves (31) and discharged into the space defined by the well casing through the holes in nozzles (32). This air discharge forces the mud, sand, and debris above nozzles 32 upward and out of the well. If, after development, it is determined that added perforations are needed, drill string (2) and tool head (17) can be rotated an additional 90° to re-establish tool (1) in the perforating mode. Perforating can thus be carried out as described above.

After the well has been developed, air pressure is turned off. The action of spring (45) acting on return sleeve (44) will cause perforator wheel (53) to retract into housing (5). The tool can now be removed from the well.

Having described the invention and its operation in detail, it will be apparent to those skilled in the art that many modifications of the invention could be made without departing from the true spirit and scope thereof. I claim as my invention all such modifications as fall within the scope of the appended claims.

I claim:

1. The method of perforating and developing a well having a casing comprising the steps of:

inserting a tool having a perforator and a source of pressure fluid thereon into the well;

piercing into the lower end of the well casing wall a plurality of separate non-connected perforations;

holding the perforator in engaging position with at least one perforation in the well casing;

and developing the well after perforation by discharging pressurized air from the tool at a position above the perforations while the perforator is in engagement with the well casing, so that sand, mud and debris are forced from the well while the tool remains within the well.

* * * * *